US007275484B2

(12) United States Patent
Franz et al.

(10) Patent No.: US 7,275,484 B2
(45) Date of Patent: Oct. 2, 2007

(54) DATA CARRIER COMPRISING A GRAVURE PRINTED IMAGE AND METHODS FOR TRANSPOSING IMAGE MOTIFS INTO LINEAR STRUCTURES AND ONTO A GRAVURE PRINTING PLATE

(75) Inventors: Peter Franz, Bruck (DE); Rüdiger Schmidt, München (DE); Stefan Winkler, München (DE)

(73) Assignee: Giesecke & Devrient GmbH, Munich (DE)

( * ) Notice: Subject to any disclaimer, the term of this patent is extended or adjusted under 35 U.S.C. 154(b) by 275 days.

(21) Appl. No.: 11/064,944

(22) Filed: Feb. 25, 2005

(65) Prior Publication Data

US 2005/0139100 A1 Jun. 30, 2005

Related U.S. Application Data

(62) Division of application No. 10/344,704, filed as application No. PCT/EP01/10286 on Sep. 6, 2001, now Pat. No. 6,964,227.

(30) Foreign Application Priority Data

Sep. 8, 2000 (DE) ..... 100 44 403

(51) Int. Cl.
*B41N 6/00* (2006.01)

(52) U.S. Cl. ..... 101/401.1; 101/150; 101/395

(58) Field of Classification Search ..... 101/401.1, 101/150, 395

See application file for complete search history.

(56) References Cited

U.S. PATENT DOCUMENTS 4,557,596 A 12/1985 Muller et al.
4,659,113 A 4/1987 Müller ..... 283/94
5,178,418 A 1/1993 Merry et al. ..... 283/73
5,329,381 A 7/1994 Payne ..... 358/455
5,486,928 A 1/1996 Doublet et al. ..... 358/299
5,675,420 A 10/1997 Beckett et al. ..... 358/299

(Continued)

FOREIGN PATENT DOCUMENTS

EP 0 144 138 6/1985

(Continued)

OTHER PUBLICATIONS

Observations on Japanese Patent Application No. 2002-524918 filed in Japanese Patent Office.

(Continued)

*Primary Examiner*—Minh Chau
(74) *Attorney, Agent, or Firm*—Bacon & Thomas, PLLC

(57) ABSTRACT

A data carrier printed by line intaglio having a halftone image represented by irregular line structures in the manner of an engraving. The line structures are superimposed at least partly by fine structures rendered in positive or negative representation. Methods are provided for generating and processing irregular line structures as digital image data on a computer following individual specifications by an operator. The line structures are transferred to a line intaglio printing plate. The digital image data is used for controlling an engraving apparatus. In the alternative, other printing processes may be involved wherein the digital image data is superimposed at least partly with fine structures rendered in positive or negative representation.

23 Claims, 7 Drawing Sheets

U.S. PATENT DOCUMENTS

| | | | | |
|---|---|---|---|---|
| 6,840,721 | B2 | 1/2005 | Kaule et al. | 409/132 |
| 2001/0043842 | A1 | 11/2001 | Kaule et al. | 409/132 |

FOREIGN PATENT DOCUMENTS

| | | | |
|---|---|---|---|
| JP | 03-053972 | | 3/1991 |
| JP | 03053972 | | 3/1991 |
| JP | 03053972 | A | 3/1991 |
| JP | 11291609 | | 10/1999 |
| JP | 11291609 | A | 10/1999 |
| JP | 11291610 | | 10/1999 |
| JP | 11291610 | A | 10/1999 |
| JP | 2000-218921 | | 8/2000 |
| JP | 2000-218922 | | 8/2000 |
| JP | 2000-263373 | | 9/2000 |
| JP | 2000263373 | | 9/2000 |
| WO | WO83/00570 | | 2/1983 |
| WO | WO90/08046 | | 7/1990 |
| WO | WO91/11331 | | 8/1991 |
| WO | WO97/48555 | | 12/1997 |

OTHER PUBLICATIONS

Jura Security Printing Design System, 1999; 55 pages.
"Conference Update", Newsletter of International Government Printing and Publishing Association, Jun. 2000, vol. 5, Issue 4.
Affidavit, Gellért Barát, Aug. 22, 2005.
Affidavit, Attila Barát, Aug. 19, 2005.
"Engraving Software", Glenisys Ltd., 2000.
Jura Engraver and Layout, date unknown.
Affidavit, Boglárka Papp, Aug. 22, 2005.
"What is the future of printing and publishing in the new millennium", Newsletter of International Government Printing and Publishing Association, Nov. 2000; vol. 5, Issue 5.
"Enlargement of the 100-franc note medallion (1917)", The Swiss Banknote 1907-1997: Michel de Rivaz, 1997.
"Woman from Brienz", The Swiss Banknote 1907-1997; Michel de Rivaz, 1997.
"Modern young girl", The Swiss Banknote 1907-1997; Michel de Rivaz, 1997.
"Young Nidwaldian girl", The Swiss Banknote 1907-1977: Michel de Rivaz, 1997.
"Woman from Haslital", The Swiss Banknote 1907-1977; Michel de Rivaz, 1997.
"Haslitalerin 100-franc reserve note, 1942", The Swiss Banknote 1907-1997; Michel de Rivaz, 1997.
"Project for the verso of the 'Chemistry' 500-franc note" second version; The Swiss Banknote 1907-1997; Michel de Rivaz, 1997.
"Intaglio proof of the subject of p. 160"; The Swiss Banknote 1907-1997; Michel de Rivaz, 1997.
U.S. Bureau of Engraving and Printing: Features of the $100 note; 2005; 5 pages.
Computer Graphics Proceedings, Annual Conference Series, "Digital Facial Engraving" Siggraph 99; 1999; 5 pages.
Affidavit, Mr. Thomas Schmidt, Feb. 28, 2005.
Graphical Models and Image Processing, vol. 58, No. 1, article 3; Jan. 1996; pp. 38-64.
The Visual Computer, 1994; vol. 10, pp. 277-292.
"Evaluation of Security Features in New Design U.S. Currency"; Sara E. Church and Thomas F. Ferguson; SPIE vol. 3314, 14 pages, date unknown.

DATA CARRIER COMPRISING A GRAVURE PRINTED IMAGE AND METHODS FOR TRANSPOSING IMAGE MOTIFS INTO LINEAR STRUCTURES AND ONTO A GRAVURE PRINTING PLATE

CROSS REFERENCE TO RELATED APPLICATION

This application is a divisional application of U.S. patent application Ser. No. 10/344,704 filed Aug. 5, 2003, now U.S. Pat. No. 6,964,227.

BACKGROUND

This invention relates to a data carrier printed by line intaglio and to a method for transferring any picture motifs to a line intaglio printing plate.

In intaglio printing the ink-transferring areas of the printing plate are provided with depressions. The depressions are filled with ink, surplus ink removed from the plate surface by means of a wiping cylinder or doctor blade so that only the depressions are filled with ink, and the inked plate pressed against a substrate, which usually consists of paper. Upon separation of the substrate and plate, ink is transferred from the depressions in the plate surface to the substrate. A distinction is made between rotogravure and line intaglio.

In conventional rotogravure, an image is produced by small, closely adjacent but separate cells in the printing plate that are filled with relatively fluid ink. After transfer to the substrate to be printed, the ink spreads and the sharp delimitation between the individual image points is blurred. Different color tones or gray values are produced in rotogravure either by a varying density of the cells or by a different cell depth and size via the quantity of ink transferred during printing.

In line intaglio printing, on the other hand, the ink-transferring depressions of the printing plate are not point-shaped as in rotogravure, but usually linear (hence the term "line intaglio"). The bearing pressure between printing plate or cylinder and substrate is very high, causing the substrate material to be also permanently embossed during printing. The transferred ink is of pasty consistency and remains standing after transfer to the substrate, thus being able to form, after drying, structures that are not only visible but also detectable with the sense of touch if the ink layer thickness is sufficient.

In the traditional method for producing line intaglio printing plates, a picture motif to be represented is resolved by line structures and these lines incised manually into a metal plate. The engraved metal plate could be used directly as a printing plate, but is usually first duplicated with common molding and electrotyping techniques. Manual production of the plate original requires great artistic ability and craftsmanship for appealing and true-to-detail rendition of the motif, it offers hardly any possibilities of alteration or correction, and it is time-consuming and expensive. Therefore, a so-called "engraving drawing" is frequently prepared first, in which the conversion of the motif to be represented into line structures is effected graphically in the first step. The possibilities of alteration and correction when preparing the drawing are somewhat wider compare to direct engraving in a metal plate, but altogether still very limited. The demands on the draftsman's artistic ability and craftsmanship are still very high.

By photographic means the engraving drawing can be transferred to a transparent foil through which a photoresist layer located on the printing plate is exposed. In the areas corresponding to the lines of the drawing the plate surface is uncovered and the ink-receiving depressions then produced by etching. The produced depth depends not only on etching time but also on line width, since fine lines lead to a lower etching depth than wide lines in the same etching time. It is possible to produce etching depths that greatly differ and are largely independent of line width on a printing plate by this method only in very limited fashion by repeating etching several times. Between the individual etching operations, additional cover layers are applied to or removed from the plate in certain areas. The additional working steps make this procedure very elaborate. Furthermore, the fineness of the producible structures is limited and the result of etching not precisely reproducible.

WO 97/48555 presents a method for transferring a drawing consisting of lines to the surface of a printing plate by engraving. For each line of the drawing, a path extending along the edge contour of the line is calculated for the engraving tool. This procedure is free of the limitations resulting from plate etching, but it still requires elaborate and inflexible preparation of an engraving drawing that offers hardly any possibilities for subsequent alteration.

WO 83/00570 describes a method for representing a halftone image by freely selected raster elements. The total image area is covered with regularly disposed raster elements and the tonal value of an image area is rendered by representing the raster element corresponding to this image area with a line thickness previously assigned to the relevant tonal value. However, such raster structures disposed uniformly throughout the image area produce a synthetic, inanimate expression, in particular in portraits. Furthermore, there are usually always image areas where the geometry of a single raster element is well recognizable and accessible to potential imitators. Since the structure of the raster is constant throughout the image area, it is relatively easily possible to reproduce and forge images rastered in this way.

SUMMARY

The problem of the present invention is to propose a data carrier whose printed image produced by line intaglio is of more complex design and therefore safer from forgery. Further, a method is to be proposed for transferring any picture motifs to a line intaglio printing plate and not having the limitations of the prior art. In particular, the method should permit faster and more flexible conversion of a picture motif, facilitate alterations and corrections in the graphic conversion of the picture motif, and permit a more complex design of the printed image.

This problem is solved by a data carrier and method with the features of the independent claims. Advantageous developments of the invention are the subject matter of the subclaims.

A data carrier according to the present invention has a halftone image printed by line intaglio and rendered in the manner of an engraving. That is, the contours, contrasts and tonal values of the picture motif to be represented are rendered by irregular line structures whose distance, line width, geometry and type can be varied selectively in the printed image in order to achieve different visual impressions. The printed image has repetitive printed structural elements, for example lines or crossing lines, which are at least partly superimposed by a fine structure. The fine structures integrated into the structural elements enormously increase the complexity of the printed image, thereby distinctly reducing its imitability and forgeability. Moreover, the fine structure permits the visual impression achieved by the structural elements to be additionally changed. The expressiveness and animateness peculiar to a picture motif produced by engraving technology, which are produced by the individual design and arrangement of the line structures, are nevertheless retained.

The fine structures can be formed by blank, i.e. unprinted, areas, present in the printed structural elements, which can be uninterrupted and continuous, or interrupted at regular or irregular intervals. It is likewise possible to resolve the printed structural elements by the superimposition with a fine structure, i.e. the area of the structural elements originally bearing ink is replaced by individual printed characters or symbols rendered in positive representation. Only the contour of the structural elements remains the same. The fine structures can form a text of any design, alphanumeric characters, logos, symbols, geometrical figures or the like.

If the fine structures are designed accordingly, they can be used as additional information or authenticity features that are visually visible or hidden in the printed image, readable only by technical aids. It is likewise possible to form the fine structures as anticopying structures.

If the fine structures are rendered in negative representation, i.e. as unprinted blank areas in printed surroundings, in particular lines or the crossing area of crossing lines can be designed advantageously. It is thus possible to leave blank an unprinted line in a printed line, whereby the unprinted line can also be designed as a double or multiple line. The unprinted line preferably extends precisely parallel to the geometrical center line of the printed line. The blank areas can also be designed as characters, patterns, symbols, which for example represent a readable text or a logo distinctive of the manufacturer. Depending on their size, such texts or symbols can be easily checked without or with aids, for example a magnifying glass.

If the structural element is formed by crossing lines, in particular the total crossing area or an area of a line extending parallel to the crossing area can be left blank. It is likewise possible to leave blank a character or symbol of any design in the crossing area, thereby rendering it in negative representation.

If the fine structure is rendered in positive representation, on the other hand, a structural element, for example a line, is resolved by any individual positively printed characters or symbols. The characters or symbols can be interconnected or spaced apart and are preferably disposed along the geometrical center line of the line to be resolved. The characters or symbols can be incorporated in constant or varying size. If the line to be resolved varies in its line width, a preferred embodiment consists in rendering the line without an edge by characters or symbols varying in their size and/or line thickness in accordance with the line width.

For reliable reproduction of fine structures by printing technology, line thicknesses for positive representation are preferred that are greater than or equal to 25 microns, while blank areas for negative representation are preferred that have a clear width of 35 microns or more. Positive and negative representations can also be combined at will. Thus, both representations can not only be used at different places within a printed image but also be combined within a structural element in any arrangement and order. Independently of whether a positive or negative representation is selected for the fine structure, characters and/or symbols of a structural element can be combined at will within a structural element, and adjacent structural elements designed with the same, regularly alternating or completely different fine structures. For superimposition with a fine structure, the line structures preferably used have a line width of at least 200 microns in the printed image.

For producing the inventive halftone image, a picture motif is made available according to the inventive method as a digital data record, the image data being present as pixel data. The picture motif is displayed visually on the basis of the pixel data and can thus serve as an original for subsequent graphic conversion of the picture motif in the manner of an engraving drawing. Following specifications by an operator, individual line structures are generated in an electronic data processing system that render the contours and halftones of the picture motif. For image areas that are to achieve a different visual impression, different line structures are generated. The digital image data rendering the line structures are stored in a vector-based data format. If desired, the individual lines of the line structures or the corresponding image data are processed in the electronic data processing system. This can serve to achieve a truer-to-detail representation or a nuanced change of the visual impression of an image or image area. The optionally processed digital image data are stored while retaining the vector-based data format. These digital image data are then used to control a precision engraving apparatus, in such a way that depressions corresponding to the line structures are produced in the surface of a line intaglio printing plate.

A particular advantage of this procedure in the production of line intaglio printing plates is that the intermediate step of preparing a physically present engraving drawing can be omitted by outputting the digital image data to a printer or film exposer. Conventional engraving or etching methods, on the other hand, require this intermediate result. Since each additional intermediate step not only takes time and effort but is also a possible error of source, the inventive method is not only faster and more economical but also more reliable. Because the output of an engraving drawing and its further use in engraving or etching necessarily involve tolerances, the inventive method also allows a truer-to-detail and dimensionally more accurate conversion of the picture motif to the line intaglio printing plate due to the direct processing of the digital image data. Furthermore, it is possible without great effort to replace a detail of the digitally stored picture motif and render it by changed line structures, such as the inventive fine structure. The picture motif can be scaled, rotated and mirrored at will by means of the electronic data processing system, without anything having to be changed in a concretely existing drawing, which always has a fixed size. It is also unnecessary to produce a new printout or expose a film for each altered variant of the processed picture motif.

In connection with the present invention, by which a picture motif is rendered by irregular line structures, the latter refer not only to continuous and interrupted lines but also to dash-lined, dash-dotted and dotted lines. Other geometrical symbols that are disposed at regular intervals along a mathematical line can also constitute a line structure according to the invention.

The engraving can be effected according to the invention by means of cutting methods such as milling, scraping or planing, and by noncontacting material removal methods such as laser engraving. Precision milling methods are preferably used. The engraved plate can be used directly as a printing plate or serve as an original for common molding and duplication processes by which the printing plates used in line intaglio printing are first produced.

If the image data for carrying out the inventive method are not yet present as a digital image file, a picture motif must first be electronically acquired and digitized. For this purpose an image is first prepared from the motif to be represented and then broken down into individual image points, usually called "pixels." Besides the coordinates, a gray or color value is also detected for each pixel. The selection of the motif to be imaged is subject to no limitations. The originals used can be real objects, for example sculptures, buildings or landscapes, or halftone images, such as photographs or paintings. For digitizing motifs already present as images, a scanner can preferably be used, which must of course have an appropriate resolution. For digitizing the image of a real object, a video camera or digital camera is preferably used. To permit the sequence of subsequent method steps to be arranged independently of each other in terms of time, the digital image data referred to as "pixel data" are stored.

Visual display of the digital image data is effected on the basis of the pixel data, preferably on a monitor. If desired or required, the pixel data are electronically retouched, which refers to their processing in an electronic data processing system. Retouching can be done to remove disturbing details, strengthen or weaken contours or change the contrasts of the image, optionally only for individual image areas.

Analogously to the procedure in manually preparing an engraving drawing, irregular line structures rendering the contours and halftones of the picture motif to be represented are generated in an electronic data processing system following specifications by an operator. The visual display of the picture motif effected on the basis of the pixel data advantageously serves as an original here. The conversion of the picture motif into line structures is particularly facilitated if the digitized picture motif rendered by the pixel data is inserted in the background on a monitor while the operator generates the desired line structures in the foreground. The pattern of the generated lines can be manually specified by the operator, the coordinates of the line pattern lying in a plane being detected by an input medium and transferred to the data processing system. This can be suitably done using in particular a drawing tablet or a computer mouse; a so-called trackball or a joystick is also a possible input medium.

The digital image data rendering the line structures are stored in a vector-based data format. In particular with very high-resolution graphics, less memory space is required for a data format based on vector representation than for a pixel-based data format with corresponding resolution. Subsequent processing steps can be performed faster due to the smaller amount of data.

For generating and processing line structures that are to render a given picture motif in appealing and true-to-detail fashion, it is advantageous to visually display the line structures directly during each change. This permits the operator to perceive a change initiated by him in the image instantaneously in every phase and check its influence on the optical appearance of the image, for example on a monitor. During processing of the digital image data rendering the line structures, structural elements such as lines or crossing points can be changed selectively. The thus processed digital image data are finally stored and used directly for controlling a precision engraving apparatus at any later time. The data format based on a vector representation is retained during storage of the processed image data.

Control of the engraving apparatus is effected by producing depressions intended for receiving ink in the surface of a line intaglio printing plate in accordance with the pattern and geometry of the line structures represented by the digital image data.

The inventive method fundamentally makes it possible to specify a value independent of line width for the engraving depth in the printing plate. This value can be fundamentally constant for all or some of the lines to be engraved, but it can also be calculated with program control by a predetermined mathematical relation in dependence on the particular line width. It is also possible for the operator to specify any desired engraving depth only for one line, a partial area of a line or a group of lines, as long as this is within the scope of the technological possibilities. In particular with lines of small line-width, the convertible engraving depth is of course subject to limitations in terms of production engineering.

The inventive methods allow simple processing of motifs to be printed, in particular processing of the inventive structural elements. In particular, the line thickness and the geometry of the endings of individual lines can be selectively altered. Line endings can be given for example a rectangular, semicircular or tapered geometry. Further, it is possible to stretch, compress, distort lines or change their basic geometry. For example, the opposite limiting edges of a line are given not a parallel course, but an opposite curvature so that the line or a line segment has a lentil- or lance-shaped basic geometry. All processing steps can be performed both on a single line or simultaneously on a whole group of lines rendering a complete image area. Further, the inventive method makes it possible to perform the engraving leading to a printed line not solidly, but not to engrave an area along the geometrical center line. If the engraving is perforated only along the two edges of a line, a double line arises within the predetermined line width. Further new design possibilities result for structural elements consisting of crossing lines. For example, the digital image data can be prepared for engraving in such a way that crossing points are not engraved. Data carriers printed with corresponding printing plates then do not have any ink in the crossing area of the lines. A further variant is for only one of two crossing lines to be engraved continuously, while the second is not continued, i.e. interrupted, in the crossing area, and the two parts of the interrupted line do not touch the crossing, continuous line. A further variant is to split a line not only into a double line but to make it feathered at least in certain sections.

The equipment required for producing the line intaglio printing plate and for the actual printing operation as well as the required know-how are available to a very limited extent and require considerable material and financial resources. Since the required resources constitute a considerable barrier for potential imitators and forgers, line intaglio printing is preferably used for security printing, for example for producing bank notes, shares, passports, ID cards, high-quality admission tickets and similar documents. The inventive method for designing line intaglio printing plates permits the above-described structural elements to be converted with such precision and fineness that they can be used in the printed image of thus produced data carriers as security features that are visually visible or only checkable using a magnifying glass.

The method for producing a picture motif rendered by irregular line structures explained with reference to the production of line intaglio printing plates is fundamentally also suitable for producing originals or printing forms for other printing processes. Since conversions of a picture motif into a mode of representation in the manner of an engraving were hitherto not effected in the explained way, and its line structures are now superimposed for the first time with additional fine structures, the inventive method can also be used advantageously for processing the thus produced digital image data for example in a digital printer, film exposer, plate exposer or other digital printing process.

The above-explained possibilities and advantages, such as animateness, individuality and complexity of the-mode of representation., can also be utilized through the inventive method for other printing processes, such as offset.

Further advantages will result from the following description of examples.

DETAILED DESCRIPTION OF VARIOUS EMBODIMENTS

Figure 1:
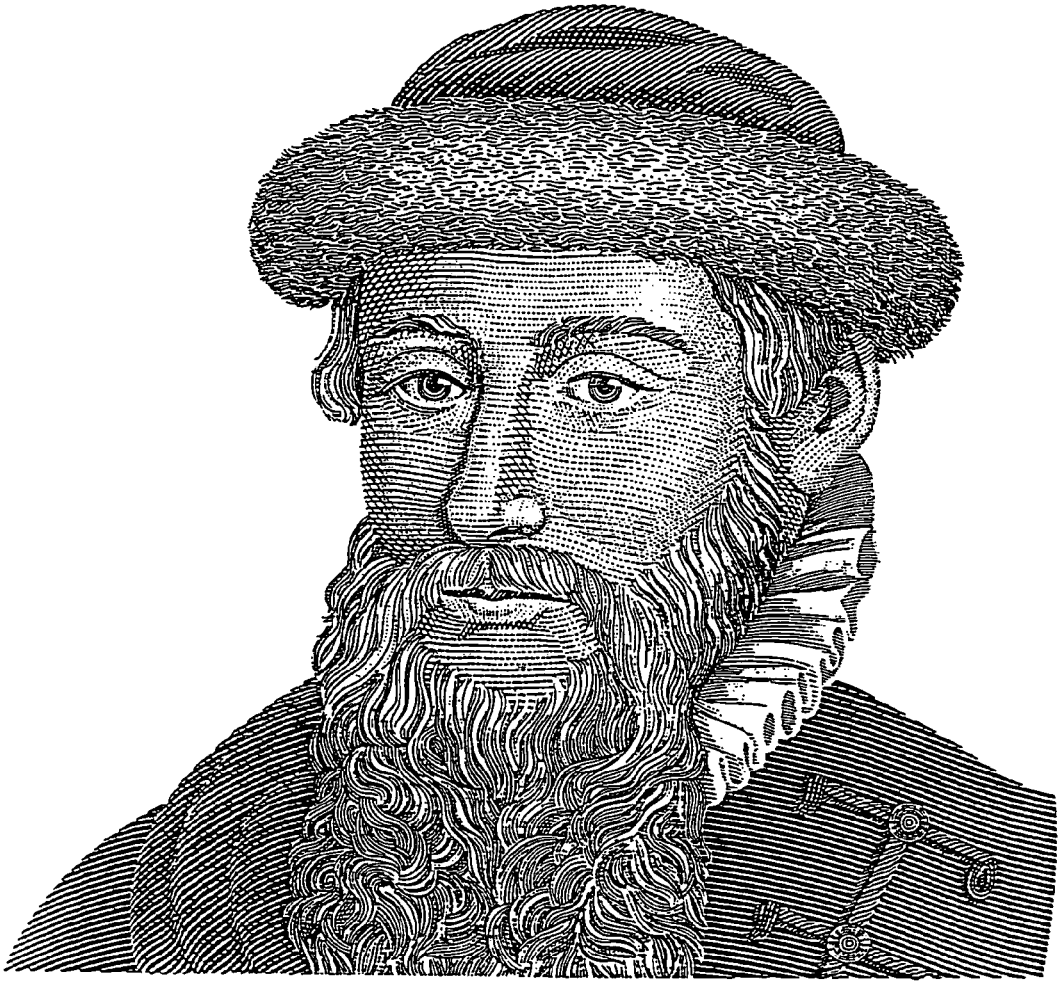
FIG. 1 shows the representation of a portrait in the manner of an engraving.

FIG. 1 shows a person's portrait in the manner of an engraving. That is, all contours and picture elements are rendered with the aid of varying line structures, as usual in an engraving representation. These structures can consist of continuous or interrupted lines, for example in the image area of the coat and beard, or of dash-lined or dotted lines, as to be well recognized in the area of the ear, cheek and forehead. According to the methods known from the prior art, such images are manually incised directly into a metal plate or drawn on paper by hand. Upon conversion of a picture motif into an engraving drawing, different shades and color or gray values are rendered by using different types of line structures for the differently toned image areas and/or varying the line width and line distance. Thus, light parts, such as the area of the forehead, cheeks and ear in the present portrait, are preferably rendered by fine, relatively far spaced-apart lines that are additionally dashed or dash-dotted or dotted. Dark image areas, for example the hat or coat in the present portrait, are preferably represented by wide, closely adjacent lines. To produce dark areas or achieve a changed optical impression, as in the area of the coat or the side of the nose, a first group of largely parallel lines, referred to as the "main layer," can also be superimposed by a so-called "secondary layer" consisting of a second group of likewise largely parallel lines.

In the conversion of such a picture motif to a line intaglio printing plate according to the inventive method, the original used for the engraving representation of the portrait may have been for example a painting that was digitized with the aid of a digital camera. The image data stored in a pixel-based data format were then retouched electronically, the contrasts of individual image areas being changed. It is frequently of advantage to accentuate or soften the transitions of pronounced contours (for example of folds in clothing or the outline of the nose). It has turned out that subsequent working steps are facilitated if the retouched pixel data are displayed visibly to the operator on a monitor. The display of the image based on the pixel data is effected in the background, while the line structures rendering the individual elements and details of the portrait are generated following specifications by the operator in the foreground. The pattern of a line is specified by the operator for example on a drawing tablet that detects the coordinates of the pattern and transfers them to a data processing system. If the basic geometry of the line and the line width are already determined, the line can be instantaneously displayed on the monitor in the desired design and is used by the operator for direct checking his actions. The process of generating a line on the basis of the operator's specifications in connection with simultaneous display of the generated line on the monitor thus largely corresponds to free manual drawing, but has the advantage that every electronically generated line structure can be subsequently processed at will. Thus, it is e.g. possible without any problem to subsequently extend or shorten a line already generated, alter the line width of the total line or of individual areas, distort a line or change the geometry of the line endings. For example, in FIG. 1 most of the lines rendering the right side of the coat end in a rectangular profile, while most of the lines rendering the beard and hair of the head have tapered endings. Semicircular line endings are just as possible as other asymmetric or user-generated geometries. Alterations and processing can be performed either on a single line or simultaneously on whole groups of lines together representing an image area.

During processing of the digital image data rendering the line structures it is possible to assign a certain engraving depth to individual lines or groups of lines. For example, a main layer can be engraved deeper or flatter than the associated secondary layer. Further, it is possible to convert individual, even very closely adjacent, lines of equal or different line width in a greatly differing engraving depth. One of two very closely adjacent lines of equal width could for example be engraved in the line intaglio printing plate with a depth of 10 microns, while the second is produced with an engraving depth of 150 microns. Such features are not realizable with conventional etching technology.

FIGS. 2 to 8 shows a detail of an engraving representation of a portrait. While parts of a face contour are recognizable in the upper left image part, a detail of the collar of the clothing and shoulder 1 are rendered in the middle and lower right image part. It is distinctly recognizable in the image details that different areas of the picture motif are represented by different, i.e. varying and thus altogether irregular, line structures.

Figure 2:
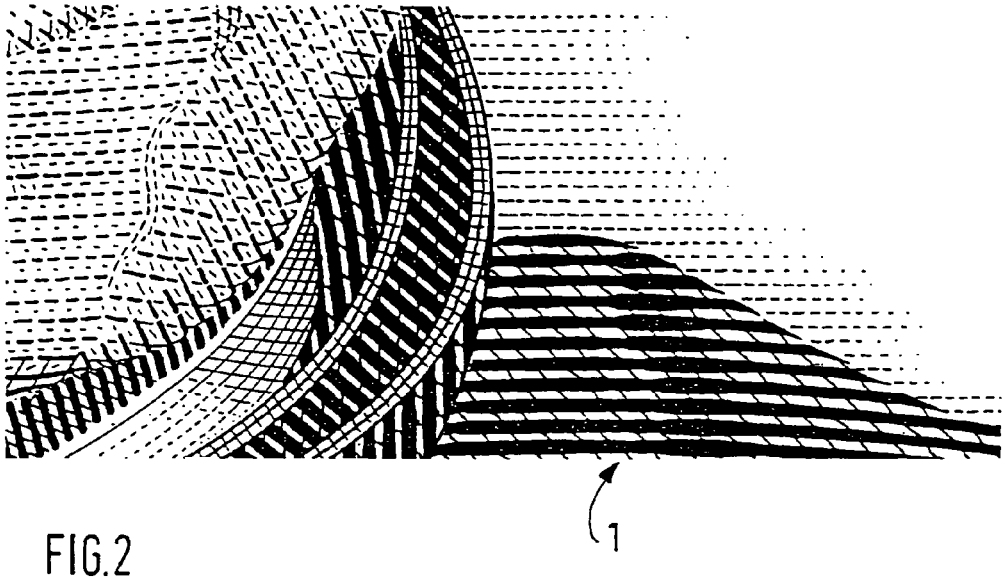
FIG. 2 shows a detail of a conventional engraving representation without fine structures.

FIG. 2 shows a portrait detail in a mode of representation according to the prior art with continuous and interrupted, as well as partly crossing, line structures. The individual lines have no additional sub- or fine structures.

Figure 3:
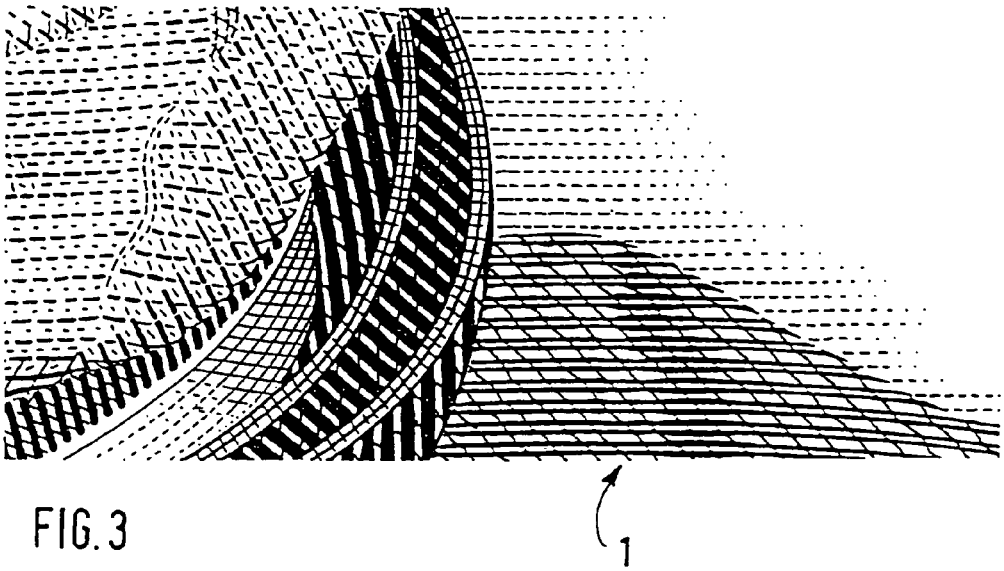
FIGS. 3 to 8 show details of an engraving representation with different variants of fine structures.

In FIG. 3 the line structures rendering right shoulder area 1 are superimposed by a fine structure. In the present example the fine structure is present as blank areas in the printed surroundings formed by the horizontal lines. The blank areas form lines rendered in negative representation located precisely on the center line of the printed lines forming the printed surroundings. The fine lines of the diagonally extending secondary layer are executed continuously so that the blank areas, i.e. the negative lines, are interrupted at the crossings of the lines of the main and secondary layers.

Figure 4:
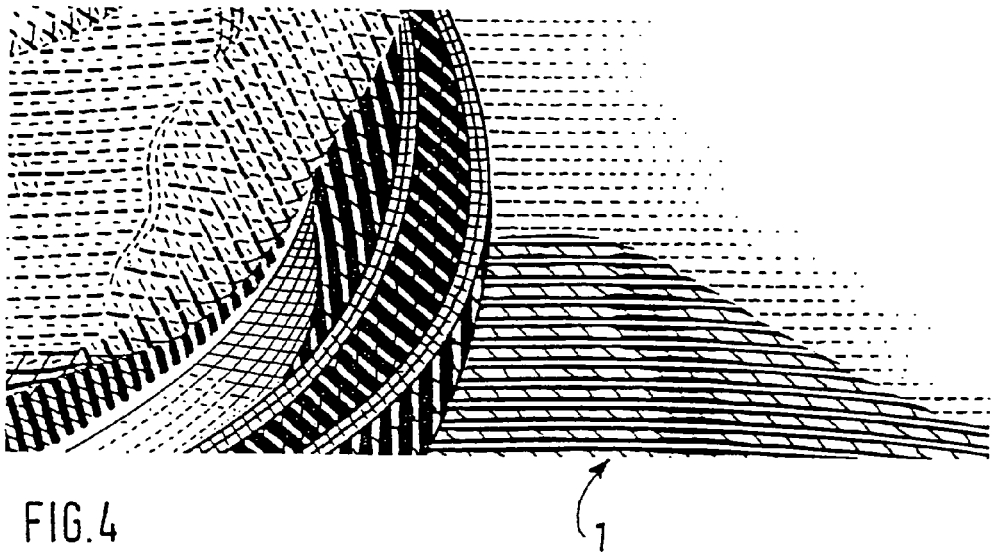

In the example shown in FIG. 4, the fine lines of the diagonally extending secondary layer are interrupted by the blank areas in the horizontal main layer. This causes the blank areas in the main layer to be uninterrupted negative lines.

Figure 5:
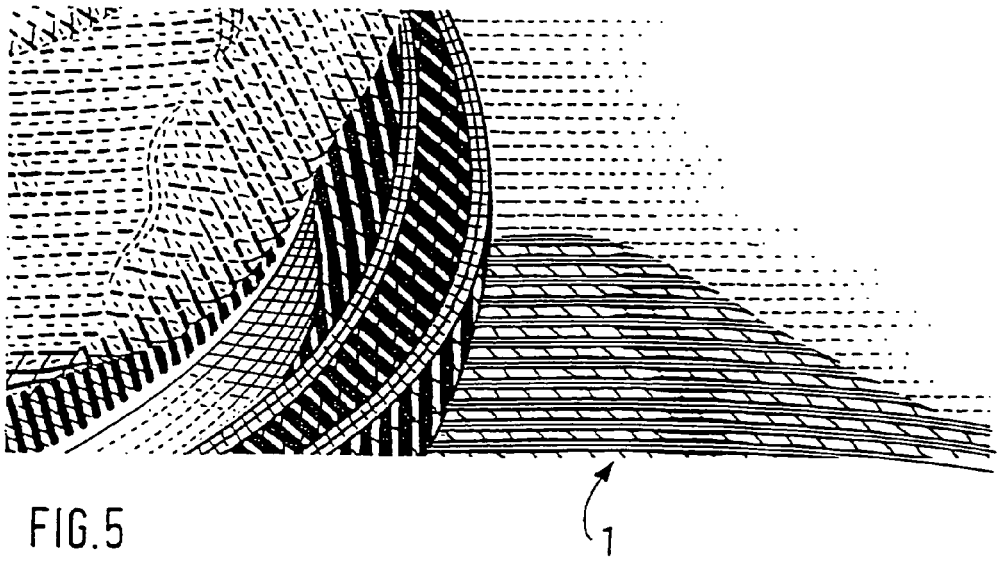

In the example of FIG. 5, the blank areas in the horizontally extending lines of the main layer of shoulder area 1 form a very fine double line in negative representation, which again extends precisely parallel to the geometrical center line. The lines of the diagonally extending secondary layer are again not continuous but likewise interrupted by the blank areas in the crossing area with the lines of the main layer.

Figure 6A:
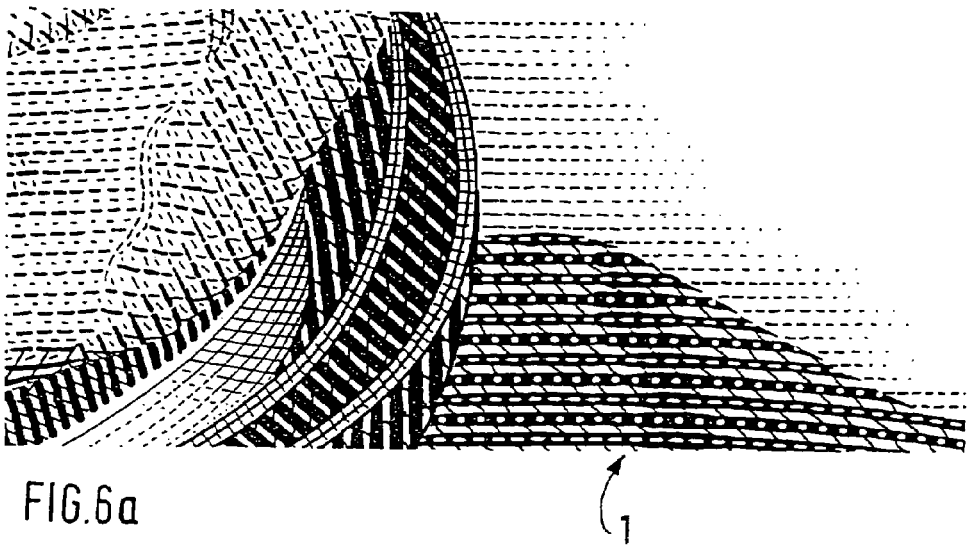

In FIG. 6*a*) the fine structure in the lines of shoulder area 1 is formed by blank areas with simple but different geometrical contours in the form of circles and short lines. The blank areas within a line all have the same form of a simple geometrical figure, while consecutive lines have different figures as blank areas.

Figure 6B:
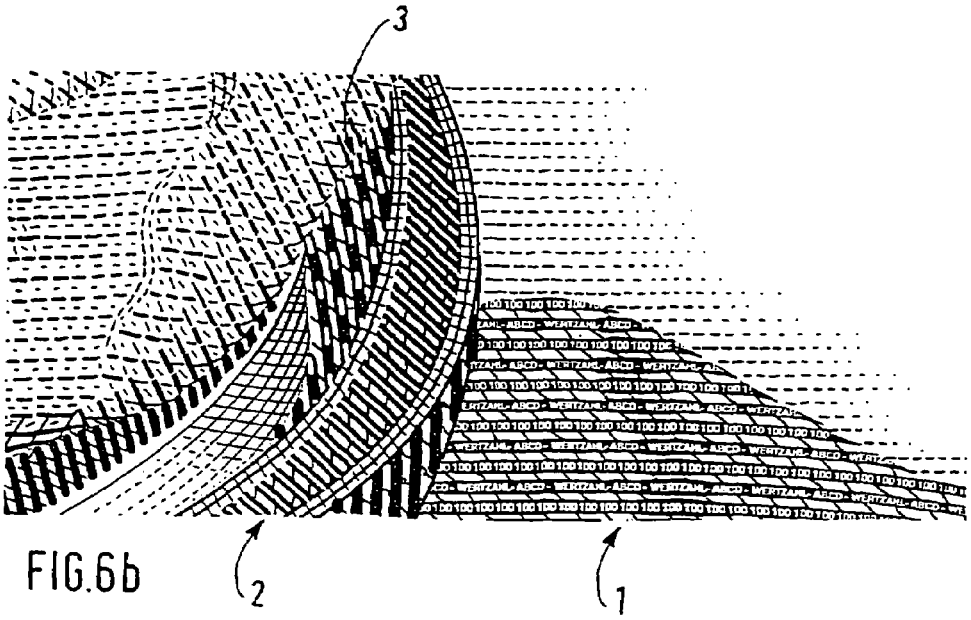

In FIG. 6*b*) the line structures of shoulder area 1 have negative structures incorporated therein that alternately represent multidigit numbers and letters in consecutive lines, the letters partly forming words. Additionally, parts of the line structures representing the collar are provided with different fine structures in FIG. 6*b*), as an example of further possible combinations. In middle collar part 2 the lines are superimposed by center lines rendered in negative representation, i.e. left blank. The lines of left collar part 3 have been superimposed by a fine structure consisting of spaced-apart blank areas of simple elongate geometry.

Figure 7:
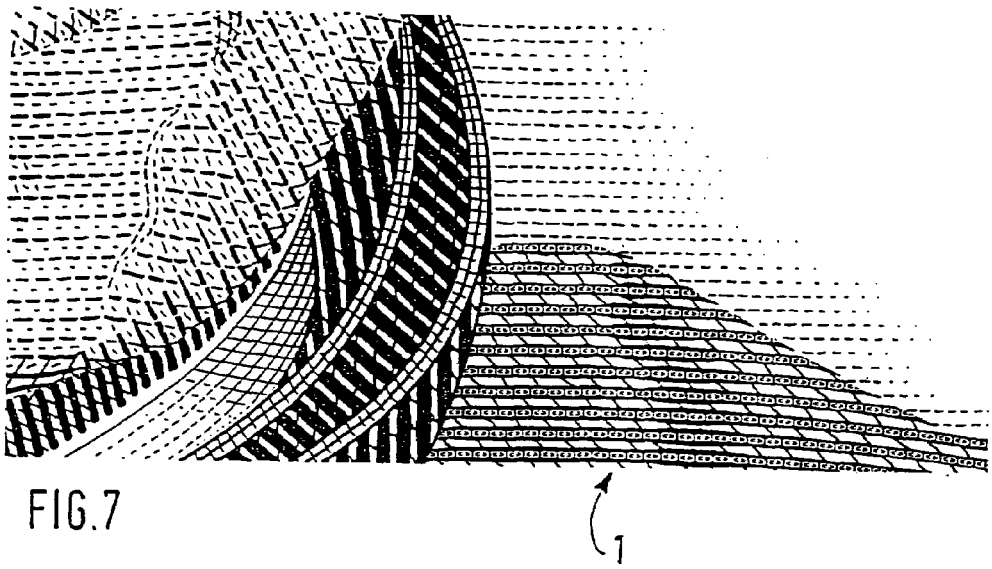

In FIG. 7 the fine structure is also formed by blank areas in the printed lines, whereby in this example a logo composed of the letters "G" and "D" is rendered in negative representation. The logo is repeated many times at uniform intervals along the lines superimposed with the fine structure.

Figure 8A:
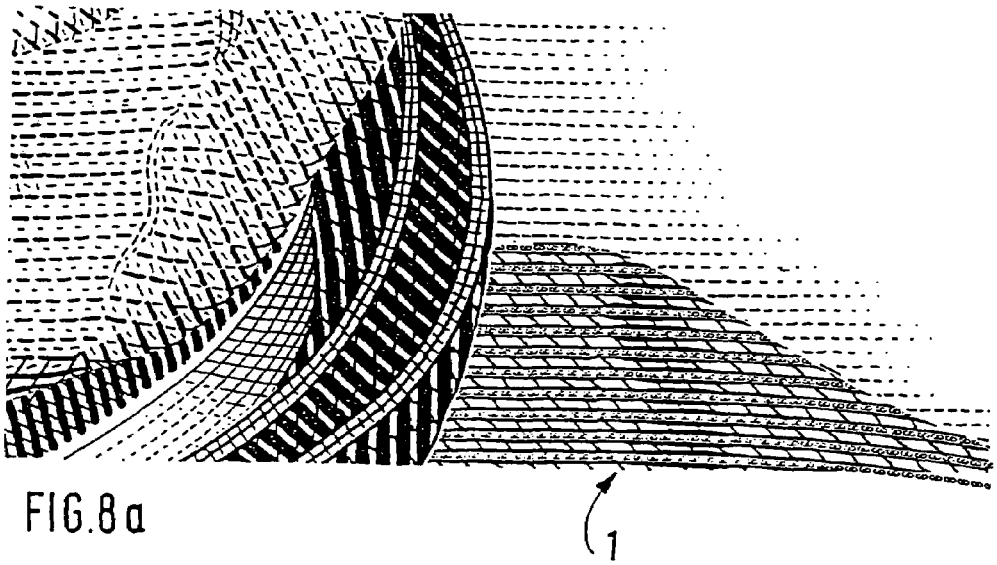
Figure 8B:
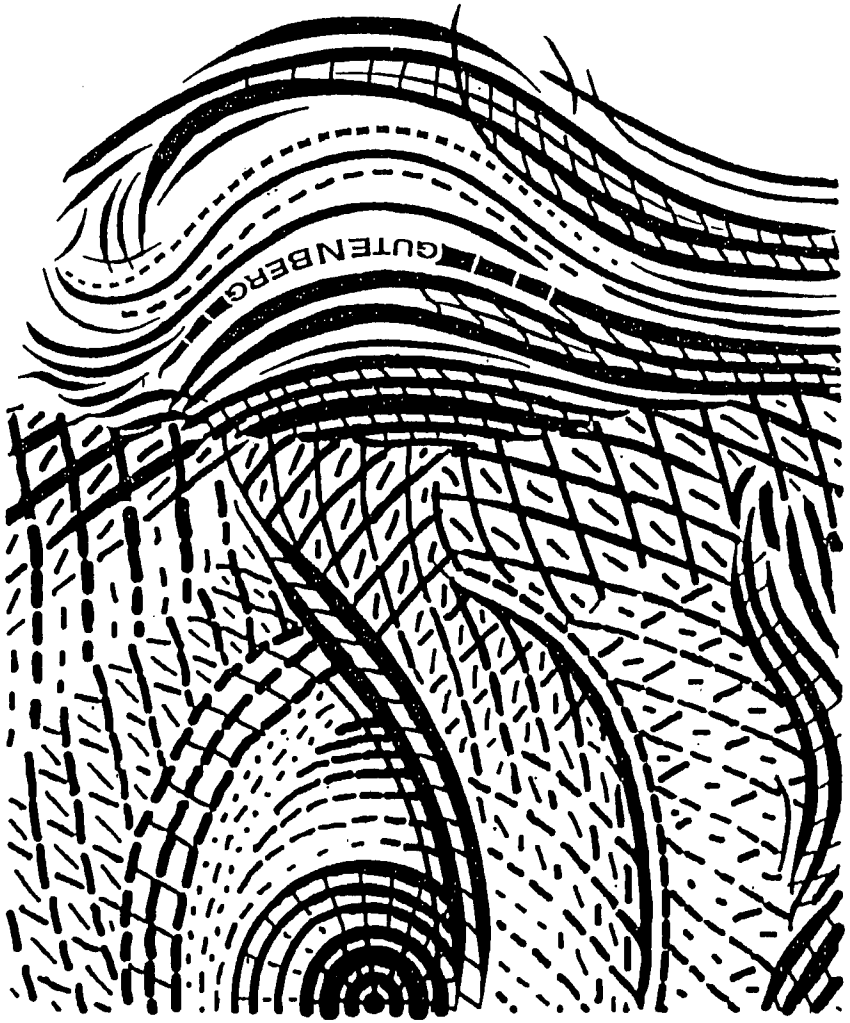

In FIG. 8*a*) the horizontally extending lines of right shoulder area 1 have incorporated therein a fine structure rendering the same logo as in FIG. 7. In FIG. 8*a*), however, a positive representation was selected for the logo, i.e. the logo is rendered by printed structures against unprinted surroundings. The line superimposed with the fine structure is thus largely resolved and only a narrow edge contour is retained. The logo is again positioned exactly on the geometrical center line and repeated many times along the center line. Instead of the representation rendered in FIG. 8*a*) it is also possible to completely resolve the line superimposed with the fine structure and render the contour pattern of its edges by characters or symbols that vary in their size and optionally also in their line thickness in accordance with the width of the line to be resolved. An example of this is shown in FIG. 8*b*). This Figure renders a detail of an engraving representation different from the previous Figures. The detail shows an enlarged representation of part of a face portrait, the left eye part and hair of the head. One of the lines rendering hairs or a tuft of hair is not executed solidly but provided with a fine structure. The fine structure consists of uppercase letters in positive representation that together form the word "Gutenberg." The arrangement and size or height of the letters follows the pattern and outside contour of the original line rendering a strand of hair. Additionally, very fine negative lines disposed at right angles to the extending direction of the strand of hair and subdividing the hair line into shorter single segments are incorporated before and after the group of letters.

The inventive data carriers are in no way limited to the fine structures shown in the examples. Any variations and combinations of different types and kinds of fine structures are possible according to the invention.

FIG. 9 schematically shows different variants of crossing lines as structural elements in an enlarged view. FIG. 9*a*) corresponds to the prior art in which both lines are printed solidly. In FIGS. 9*b*) and 9*c*) the crossing area is designed differently. In FIG. 9*b*) the fine structure consists in only one line being rendered continuously in the crossing area, while the second is interrupted in the crossing area and not printed in this interrupted area. The two parts of the interrupted line are spaced so far apart that they do not touch the first continuous line. In the embodiment according to FIG. 9*c*) both crossing lines are interrupted in the crossing area and precisely the surface that would be covered by both lines is left blank.

Figure 9A:
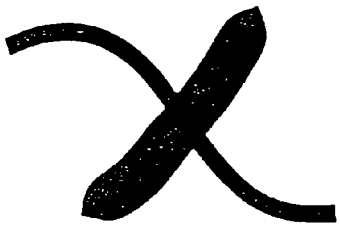
FIG. 9 shows variants of crossing lines with different fine structures.
Figure 9D:
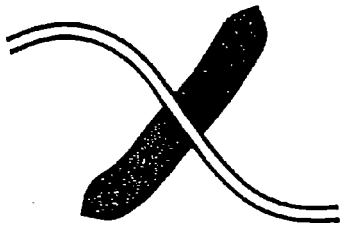

In the embodiments according to FIGS. 9*d*) and 9*e*) one of the two crossing lines is not rendered solidly over its total line width but only along its two edges limiting the line, and an area extending along the geometrical center line left blank. In the embodiment according to FIG. 9*e*) the blank center area does not have a constant width over the total length of the line but tapers to a point at the line endings.

Figure 9B:
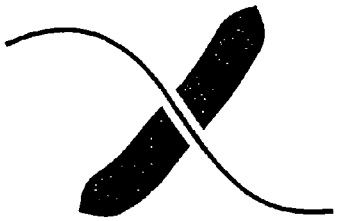
Figure 9E:
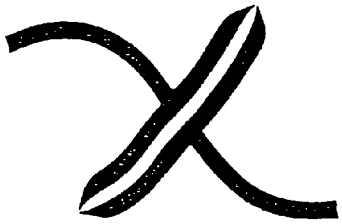
Figure 9C:
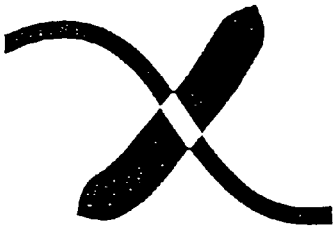
Figure 9F:
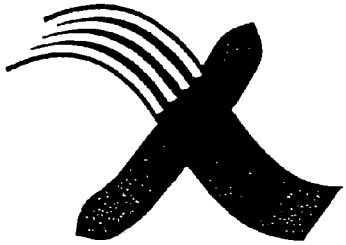

FIG. 9*f*) shows that a line has a feathered design in a subsection. This subsection is not rendered solidly but is broken down into individual finer partial lines, which can have a different geometry of the endings of the partial lines. In the example shown in FIG. 9*f*) the endings of the partial lines have rectangular and tapered geometries. The total width of the partial lines and blank spaces therebetween corresponds to the line width of the original, unfeathered line.

The variants shown in FIGS. 9*b*) to 9*f*) are different kinds of fine structures that can be integrated into the line intaglio image of the inventive data carriers individually or in different combinations.

The inventive method for producing line intaglio printing plates permits the above-described embodiments of lines or line crossings and fine structures to be executed with such fineness and precision that they are not reproducible with conventional methods known from the prior art.

The invention claimed is:

1. The method for converting a picture motif to a line intaglio printing plate comprising the steps:

(a) providing digital first image data that are present as pixel data and represent a picture motif;

(b) visually displaying the picture motif on the basis of the pixel data;

(c) generating irregular line structures, the contours and halftones of the picture motif being rendered by different line structures in certain areas following specifications by an operator;

(d) storing the digital second image data rendering the line structures in a vector-based data format;

(e) optionally processing the individual lines of the line structures and storing the processed second image data;

(f) controlling a precision engraving apparatus on the basis of the processed second image data so as to produce depressions corresponding to the line structures in the surface of a line intaglio printing plate.

2. The method according to claim 1, wherein during processing in step (e) the lines are superimposed at least partly by a fine structure causing the lines to be resolved into individual characters or symbols rendered in positive representation.

3. The method according to claim 2, wherein the fine structure forms a text, alphanumeric characters, logos, symbols or geometrical figures.

4. The method according to claim 1, wherein during processing in step (e) the lines or the crossing areas of lines are superimposed at least partly by a fine structure rendered in negative representation in the lines or crossing areas.

5. The method according to claim 4, wherein at least one line is rendered not solidly but with a blank, unengraved center line.

6. The method according to claim 4, wherein crossing lines are not engraved in the crossing area.

7. The method according to claim 4, wherein one of two crossing lines is completely engraved and continuous in the crossing area while the other is not engraved and thus interrupted in the crossing area, so that the two crossing lines do not touch.

8. The method according to claim 1, wherein during control of the engraving machine in step f an associated engraving depth is calculated from a given line width with program control.

9. The method according to claim 1, wherein a certain engraving depth is specified by the operator for a single line or a group of lines.

10. The method according to claim 1, wherein a line is rendered in feathered fashion at least in certain sections.

11. A line intaglio printing plate produced by the method of claim 1.

12. The method according to claim 1, wherein a picture motif is digitized for providing the pixel data in step (a), the picture motif being resolved into individual, pixel-like image points and the coordinates and gray or color value being determined and stored for each image point.

13. The method according to claim 12, wherein digitizing is effected with a scanner, a video camera or a digital camera.

14. The method according to claim 1, wherein the pixel data are retouched electronically.

15. The method according to claim 14, wherein the contrasts of the digitized picture motif are changed at least in certain areas upon retouching of the pixel data.

16. The method according to claim 1, wherein the visual display of the picture motif in step b is effected on a monitor.

17. The method according to claim 1, wherein during generation of the line structures in step (c) the pattern of a line is specified by the operator manually with the aid of an input medium for detecting two-dimensional coordinates.

18. The method according to claim 17, wherein the input medium is a computer mouse, a drawing tablet, a trackball or a joystick.

19. The method according to claim 1, wherein the line structures are visually displayed directly and without delay during their generation and processing in steps (c) and (e).

20. The method according to claim 1, wherein a visual display of the line structures in the background is superimposed by the picture motif rendered by the pixel data.

21. The method according to claim 1, wherein during processing of the lines in step (e) their line thickness is varied or the geometry of the line endings is changed.

22. The method according to claim 21, wherein lines are given semicircular, rectangular or tapered endings.

23. The method according to claim 1, wherein the lines are stretched, compressed or distorted during processing in step (e).

* * * * *